US006890192B2

(12) United States Patent
Riku

(10) Patent No.: US 6,890,192 B2
(45) Date of Patent: May 10, 2005

(54) SEQUENTIAL CONNECTION-TYPE CONNECTOR AND ADDITIONAL CONTACT USED IN THE SAME

(75) Inventor: Kazuya Riku, Tokyo (JP)

(73) Assignee: Tyco Electronics AMP K.K., Kanagawa (JP)

( * ) Notice: Subject to any disclaimer, the term of this patent is extended or adjusted under 35 U.S.C. 154(b) by 0 days.

(21) Appl. No.: 10/431,312

(22) Filed: May 7, 2003

(65) Prior Publication Data

US 2003/0211762 A1 Nov. 13, 2003

(30) Foreign Application Priority Data

May 9, 2002 (JP) ..... 2002-134034

(51) Int. Cl.[7] ..... H01R 4/66; H01R 13/648
(52) U.S. Cl. ..... 439/108; 439/441; 439/748
(58) Field of Search ..... 439/108, 181, 439/266, 441, 748, 847, 852, 862, 924.1, 839

(56) References Cited

U.S. PATENT DOCUMENTS 3,796,987 A * 3/1974 Kinkaid et al. ..... 439/748
4,787,886 A * 11/1988 Cosman ..... 604/9
5,626,488 A * 5/1997 Albeck et al. ..... 439/395
6,146,187 A * 11/2000 Pallai ..... 439/441
6,682,364 B2 * 1/2004 Cisey ..... 439/441

FOREIGN PATENT DOCUMENTS

JP 1988-261685 10/1988 ..... H01R/13/652

* cited by examiner

*Primary Examiner*—Michael C. Zarroli
(74) *Attorney, Agent, or Firm*—Barley Snyder

(57) ABSTRACT

A sequential connection-type connector including an insulative housing having contact-accommodating cavities, receptacle contacts accommodated in the cavities and an additional contact arranged between one of the receptacle contacts and an inside wall of the housing. The additional contact includes a contact plate portion contacting the receptacle contact, an engaging portion projecting into the inside wall of the housing, a bent portion extending from a rear end of the contact plate portion and interposed between the contact plate portion and the engaging portion, and a contact arm extending from a front end of the contact plate portion and projecting forward beyond a front end of the receptacle contact across the opening defined in the receptacle contact for insertion of a mating male contact.

18 Claims, 6 Drawing Sheets

SEQUENTIAL CONNECTION-TYPE CONNECTOR AND ADDITIONAL CONTACT USED IN THE SAME

FIELD OF THE INVENTION

The present invention relates to a sequential connection-type connector and an additional contact used in such connectors.

BACKGROUND OF THE INVENTION

Sequential connection-type connectors are used to connect wires to computers and telephone exchanges, etc. and generally comprise ground contacts, power contacts and signal contacts.

A prior art sequential connection-type connector is shown in FIG. 6. The prior art sequential connection-type connector (hereafter referred to simply as a "connector") is designated generally as 100 and comprises a housing 110 usually made of a dielectric material and having a plurality of contact-receiving passages 111*a* and 111*b*, and a plurality of receptacle contacts 121*a* and 121*b*, each accommodated and fastened inside a respective one of the contact-receiving passages 111*a* and 111*b*. The receptacle contact 121*a* is referred to as a ground contact and the receptacle contact 121*b* is referred to as a signal contact. The receptacle contacts 121*a* and 121*b* are each connected to a respective electrical wire W. The receptacle contacts 121*a* and 121*b* each include a receptacle part 122*a*, 122*b*, respectively, that receives a respective mating male contact 221*a*, 221*b* and elastic contact piece 124*a* and 124*b*. The elastic contact pieces 124*a* and 124*b* contact the respective male contact 221*a* and 221*b*, when inserted into openings defined by the receptacle contacts 121*a*, 121*b* and are arranged inside the respective receptacle part 122*a* and 122*b*.

A substantially U-shaped clip 125 is mounted on an upper wall 123*a* of the receptacle part 122*a* of the ground receptacle contact 121*a* and clamps the upper wall 123*a*. The clip 125 is separate from the ground receptacle contact 121*a*, i.e., a separate element therefrom. When the clip 125 is mounted on the ground receptacle contact 121*a*, a bent portion 125*a* at a front end of the clip 125 protrudes forward beyond the front end of the receptacle contact 121*a*. As a result of the presence of the clip 125, the ground male contact 221*a* to be connected to the ground receptacle contact 121*a* contacts the clip 125 first upon insertion into the housing 110 prior to any contact between the signal male contact 221*b* and the signal receptacle contact 121*b*. Thereafter, the signal male contact 221*b* contacts the signal receptacle contact 121*b* so that a sequential connection is obtained, i.e., first the ground connection and then the signal connection.

Sequential connectors are designed to provide such a sequential connection in order to prevent electrical noise from being generated upon the completion of the connection between the male contacts 221*a*,221*b* and the receptacle contacts 121*a*,121*b*. By preventing the generation of electrical noise, detrimental effects on data being transmitted through the connection and on a circuit board containing components involved in the connection are prevented.

In an alternative construction, the clip 125 may be mounted on an upper wall 123*b* of the receptacle part 122*b* of the receptacle contact 121*b* so that the male contact 221*b* that connects to the receptacle contact 121*b* contacts the clip 125 first.

There are several problems and drawbacks of a sequential connector having the construction described above with reference to FIG. 6.

Specifically, the receptacle contacts 121*a* and 121*b* are generally relatively large so that there is sufficient space inside the receptacle parts 122*a* and 122*b* to enable mounting of the clip 125 on either of the receptacle contacts 121*a* and 121*b*, e.g., on the upper wall 123*a* or 123*b* of the receptacle part 122*a* or 122*b* thereof. However, it is a disadvantage that when the receptacle contacts are small, there is not a significant amount of space inside the receptacle parts so that the mounting of the clip 125 on one of the receptacle contacts is difficult.

Another disadvantage is that if the clip 125 is mounted on the upper wall of the receptacle part of a small receptacle contact, the lower part of the bent portion 125*a* of the clip 125 protrudes into the mating male contact receiving space of the receptacle part. As a result, the load applied to the elastic contact piece inside the receptacle part by the mating male contact received inside the receptacle part often differs from the initial design value. If so, the desired connection performance between the receptacle contact and the mating male contact cannot be obtained.

In view of the foregoing, a sequential connection cannot be reliably accomplished for relatively small receptacle contacts.

Accordingly, the present invention is designed to overcome the problems discussed above.

SUMMARY OF THE INVENTION

It is an object of the present invention to provide a new sequential connection-type connector and an additional contact used in the same which allow for easy mounting of the additional contact while providing the sequential connection.

It is another object of the present invention to provide a new sequential connection-type connector and additional contact used in the same which enable a reliable sequential connection to be obtained even when the receptacle contacts are relatively small.

In order to achieve these objects and others, a sequential connection-type connector in accordance with the invention includes an insulating housing having contact-accommodating cavities and receptacle contacts accommodated in the contact-accommodating cavities. An additional contact is arranged between the receptacle contact inside one of the contact-accommodating cavities and an inside or inner wall of the housing. The additional contact includes a contact plate portion which contacts the receptacle contact, an engaging portion which projects into the inside wall of the housing, a bent portion extending from a rear end of the contact plate portion and interposed between the contact plate portion and the engaging portion, and a contact arm which extends from a front end of the contact plate portion forward beyond a front end of the receptacle contact and is positioned across an insertion opening defined by the receptacle contact for a mating male contact. The rear end of the contact plate portion is that end further from an opening in the housing through which the mating male contact will pass to be engaged with the receptacle contact while the front end of the contact plate portion is that end closer to the opening in the housing through which the mating male contact will pass to be engaged with the receptacle contact.

The part of the engaging portion which projects or bites into the inside wall of the housing is referred to as an anchoring part as it anchors the additional contact to the housing. In view of the projection of the anchoring part into the inside wall of the housing and the contact between the contact plate portion and the receptacle contact, the additional contact is clamped between the inside wall of the housing and the receptacle contact.

In a sequential connection-type connector in accordance with the invention, when the mating connector is mated and connected in a state in which the additional contact is inserted and arranged between the receptacle contact inside one of the contact-accommodating cavities and the inside wall of the housing, the mating male contact (essentially the same as one of the mating male contacts described above with reference to FIG. 6) to be connected to the receptacle contact that is in contact with the additional contact first contacts the contact arm of the additional contact (since the contact arm is positioned across the insertion opening defined by the receptacle contact for the mating male contact). Thereafter, the other mating male contact contacts the receptacle contact that is not in contact with the additional contact so that a sequential connection is achieved. Since the additional contact is arranged between the receptacle contact inside one of the contact-accommodating cavities and the inside wall of the housing, it can be easily mounted to enable a sequential connection even for relatively small receptacle contacts.

Furthermore, since the contact arm of the additional contact is arranged across the insertion opening for the mating male contact, the mating male contact securely contacts the contact arm upon insertion so that a sequential connection can be reliably achieved. That is, the contact arm is positioned in the path of insertion of the mating male contact to invariably cause the mating male contact to contact the contact arm.

In view of the clamping of the additional contact between the inside wall of the housing and the receptacle contact, the elastic force of the bent portion between the contact plate portion and the engaging portion acts on the contact plate portion so that contact between the receptacle contact and the additional contact is stable and ensured.

In one embodiment of the invention, the additional contact has substantially an S-shape. With this shape, a large spring region can be obtained in which case, the additional contact does not have a tendency to undergo plastic deformation.

In another embodiment of the invention, the additional contact is positioned in the direction of insertion (of the male contact) as a result of placement of the additional contact in the housing so that the bent portion abuts against a portion of the housing, for example, against a tip end of a housing lance. Thus, the direction of insertion of the additional contact into the housing is the same as the direction of insertion of the mating male contact into engagement with the housing. As such, insertion of the mating male contact does not result in further inward movement of the additional contact because such further inward movement is prevented by the abutment of the additional contact against the housing lance More specifically, in this embodiment, the additional contact is positioned in the housing between the contact inside one of the contact-accommodating cavities and the inside wall of the housing by inserting it until the bent portion of the additional contact contacts the tip end of the housing lance. Thus, the accurate positioning of the additional contact in the direction of insertion is accomplished. As a result of the bent portion of the additional contact contacting the tip end of the housing lance, the engagement of the contact by the housing lance is reinforced.

In another embodiment of the invention, expanded-width portions that regulate the movement of the additional contact in a direction perpendicular to the direction of insertion (of the male contact), i.e., lateral directions of the additional contact, are formed in one or more of the side portions of the additional contact with respect to the direction perpendicular to the direction of insertion.

In this embodiment, the movement of the additional contact in the direction perpendicular to the direction of insertion is regulated by the expanded-width portions of the additional contact during and/or after the insertion and arrangement of the additional contact. Accordingly, deviation of the additional contact in the direction perpendicular to the direction of insertion is minimized.

An additional contact used in a sequential connection-type connector in accordance with the invention generally includes a contact plate portion which is adapted to contact one of the receptacle contacts, an engaging portion adapted to project into an inside wall of the housing, a bent portion extending from a rear end of the contact plate portion and interposed between the contact plate portion and the engaging portion, and a contact arm which extends from a front end of the contact plate portion. The contact arm is adapted to extend forward beyond a front end of the receptacle contact and be positioned across an insertion opening defined by the receptacle contact for a mating male contact, i.e., cut across the insertion path or path of advance of the mating male type contact.

The additional contact can be inserted and arranged between the receptacle contact inside one of the contact-accommodating cavities and the inside wall of the housing so that an additional contact that allows a sequential connection can easily be mounted even for relatively small receptacle contacts. When the mating connector is mated and connected in a state in which the additional contact is inserted and arranged between the receptacle contact inside one of the contact-accommodating cavities and the inside wall of the housing, one of the mating male contacts which is to be connected to the receptacle contact that is in contact with the additional contact first contacts the contact arm of the additional contact. Thereafter, the other mating male contact contacts the receptacle contact that is not in contact with the additional contact so that a sequential connection is achieved. Since the additional contact has a contact arm which protrudes forward beyond the front end of the receptacle contact and cuts across the path of advance of the mating male type contact, the mating male contact securely contacts the contact arm so that a sequential connection can be reliably achieved.

BRIEF DESCRIPTION OF THE DRAWINGS

The invention, together with further objects and advantages thereof, may best be understood by reference to the following description taken in conjunction with the accompanying drawings wherein like reference numerals identify like elements.

DESCRIPTION OF THE PREFERRED EMBODIMENT

Referring to FIGS. 1–5, a preferred embodiment of the present invention will be described.

Figure 1:
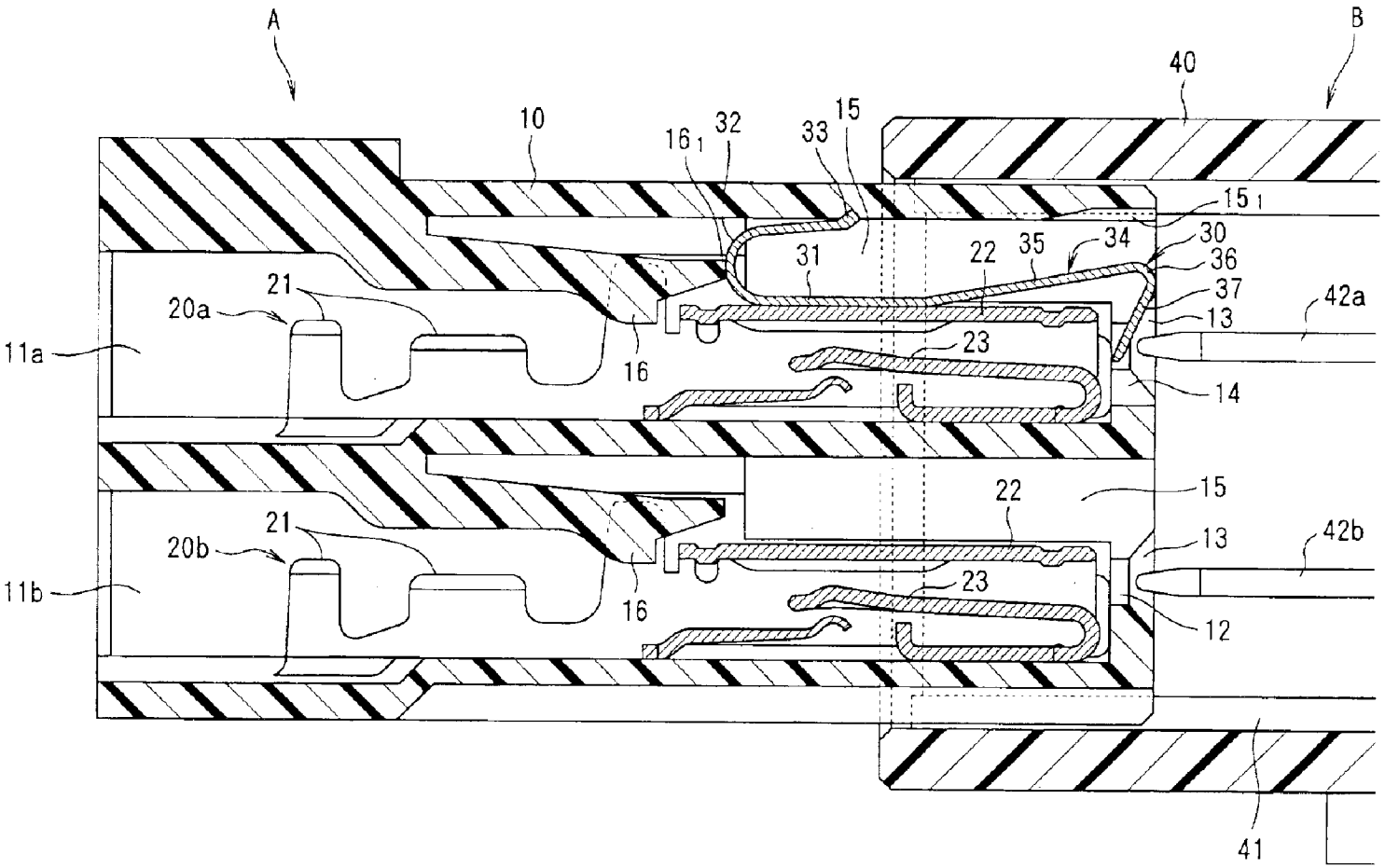
FIG. 1 is a sectional view which shows the state at an intermediate point in the mating of a sequential connection-type connector in accordance with the present invention and a mating connector.

In FIG. 1, the sequential connection-type connector (hereafter referred to simply as a "connector") A includes an insulating (dielectric) housing 10 which has a plurality of contact-accommodating cavities 11*a* and 11*b* arranged in two tiers one above the other, and receptacle contacts 20*a* and 20*b*, each accommodated inside a respective one of the contact-accommodating cavities 11*a* and 11*b*. Although only two contact-accommodating cavities 11*a* and 11*b* are shown, it is understood that the housing 10 may include any number of contact-accommodating cavities.

Connector A is mated and connected with a mating connector B. The mating connector B includes an insulating housing 40 having a connector receiving cavity 41 designed to receive the housing 10 of the connector A and a plurality of post contacts (also referred to as mating male contacts herein) 42*a* and 42*b* arranged in two tiers one above the other so that these post contacts contact the upper and lower receptacle contacts 20*a* and 20*b* when connectors A and B are connected together. The upper post contact 42*a* is a ground contact, and the lower post contact 42*b* is a signal contact. The tip ends of the respective post contacts 42*a* and 42*b* are aligned in a direction facing the contact-accommodating cavities 11*a* and 11*b* of the housing 10, which direction is referred to herein as the direction of insertion.

Rectangular openings 12, which allow the insertion of the post contacts 42*a* and 42*b* into the contact-accommodating cavities 11*a* and 11*b*, are formed in the front ends (right ends in FIG. 1) of the contact accommodating cavities 11*a* and 11*b* of the housing 10 with respect to the direction of insertion. Inclined surfaces 13 are formed on the front ends of each of the openings 12 with respect to the direction of insertion to surround the four sides of the openings 12. Housing lances 16 are formed inside the respective contact-accommodating cavities 11*a* and 11*b* to prevent the receptacle contacts 20*a* and 20*b* accommodated inside the respective contact-accommodating cavities 11*a* and 11*b* from slipping out to the rear, with respect to the direction of insertion (to the left in FIG. 1). Each of the housing lances 16 is constructed from a cantilever-form elastic member which protrudes into the corresponding contact-accommodating cavity 11*a* or 11*b* from the rear portion of an upper wall defining the contact-accommodating cavity 11*a* or 11*b*, and extends forward toward the insertion opening 12.

Figure 3:
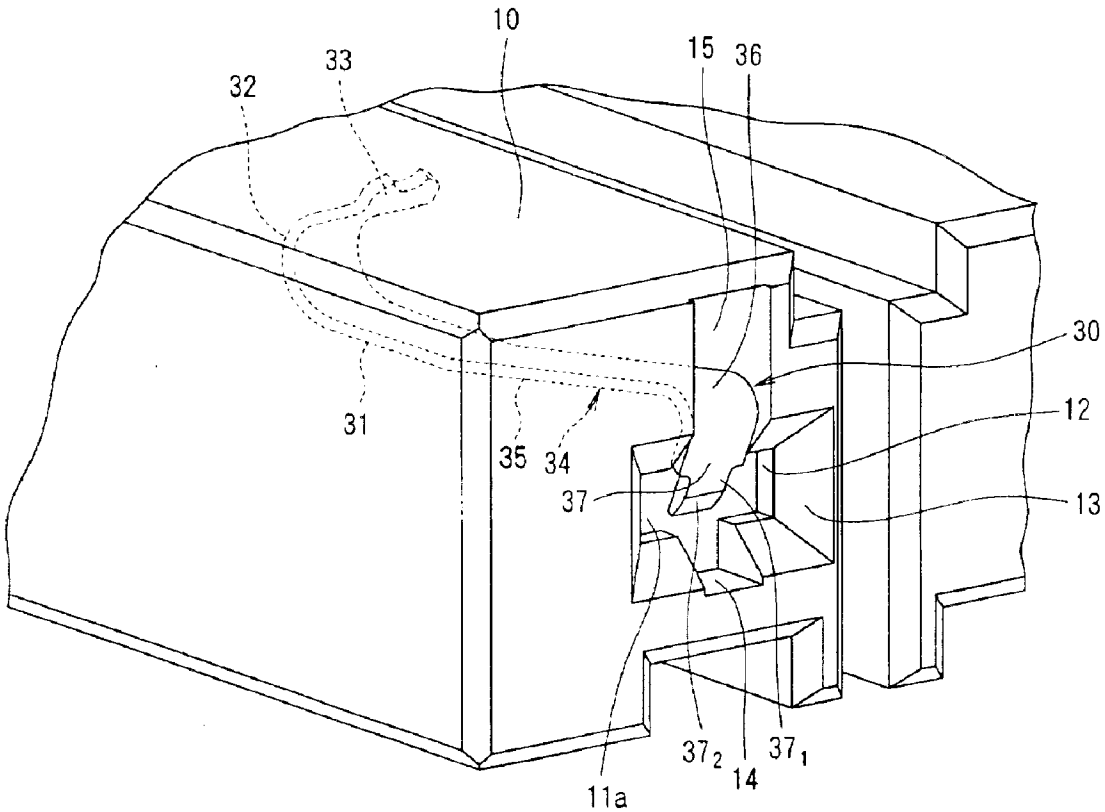
FIG. 3 is a partial perspective view of a housing constituting a part of the sequential connection-type connector shown in FIG. 1.
Figure 4:
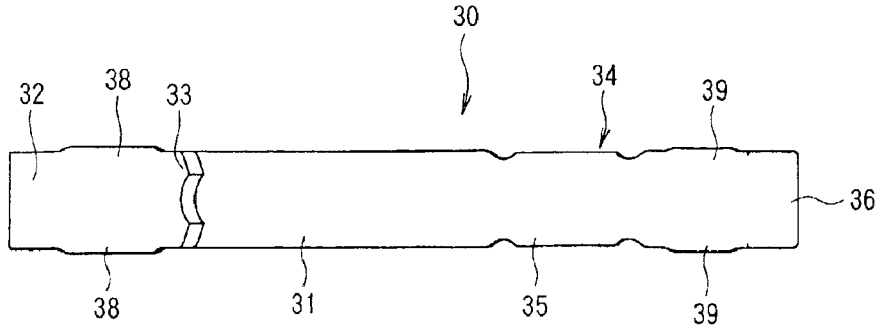
FIG. 4(A) is a plan view of the additional contact used in the sequential connection-type connector shown in FIG. 1.
FIG. 4(B) is a left-side view of the additional contact used in the sequential connection-type connector shown in FIG. 1.
FIG. 4(C) is a front view of the additional contact used in the sequential connection-type connector shown in FIG. 1.
Figure 4:
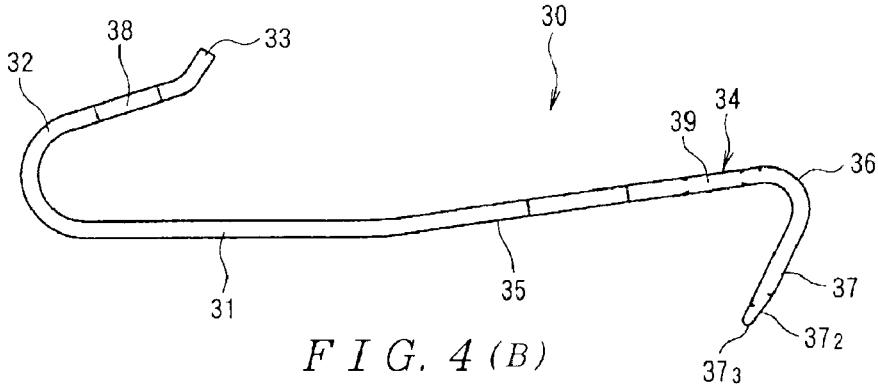
Figure 4:
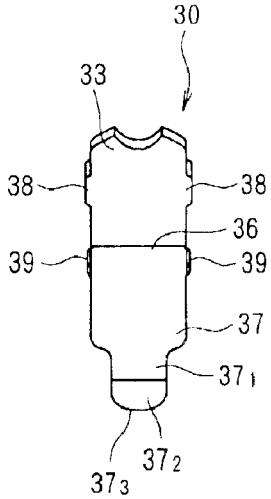
Figure 5:
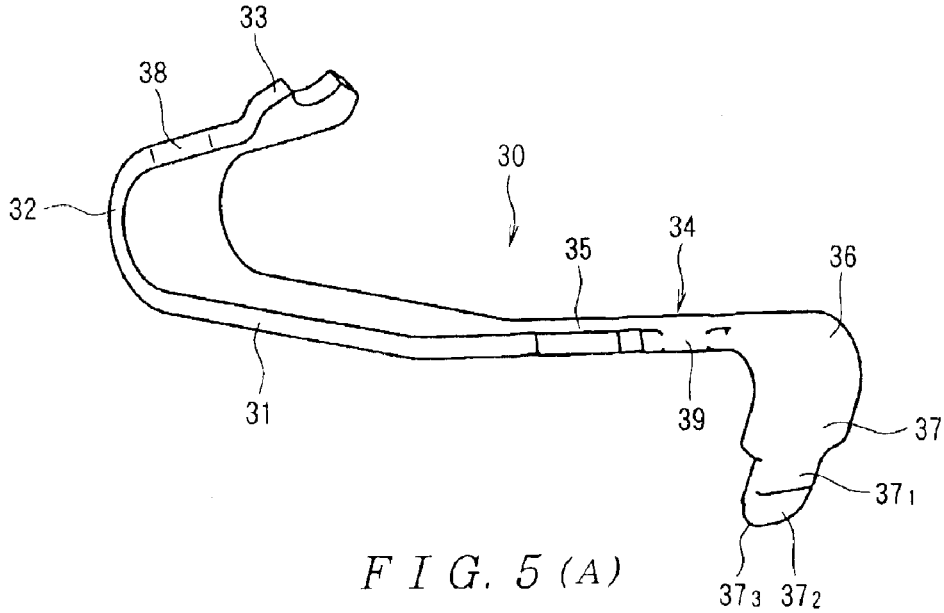
FIG. 5(A) is a perspective view as seen at an inclination from above on the front side of the additional contact inserted and arranged in the sequential connection-type connector shown in FIG. 1.
FIG. 5(B) is a perspective view as seen at an inclination from above on the back side of the additional contact inserted and arranged in the sequential connection-type connector shown in FIG. 1.
Figure 5:
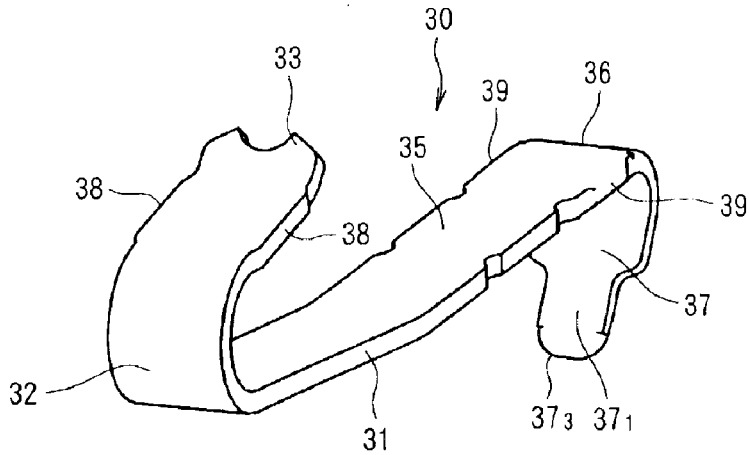
Figure 6:
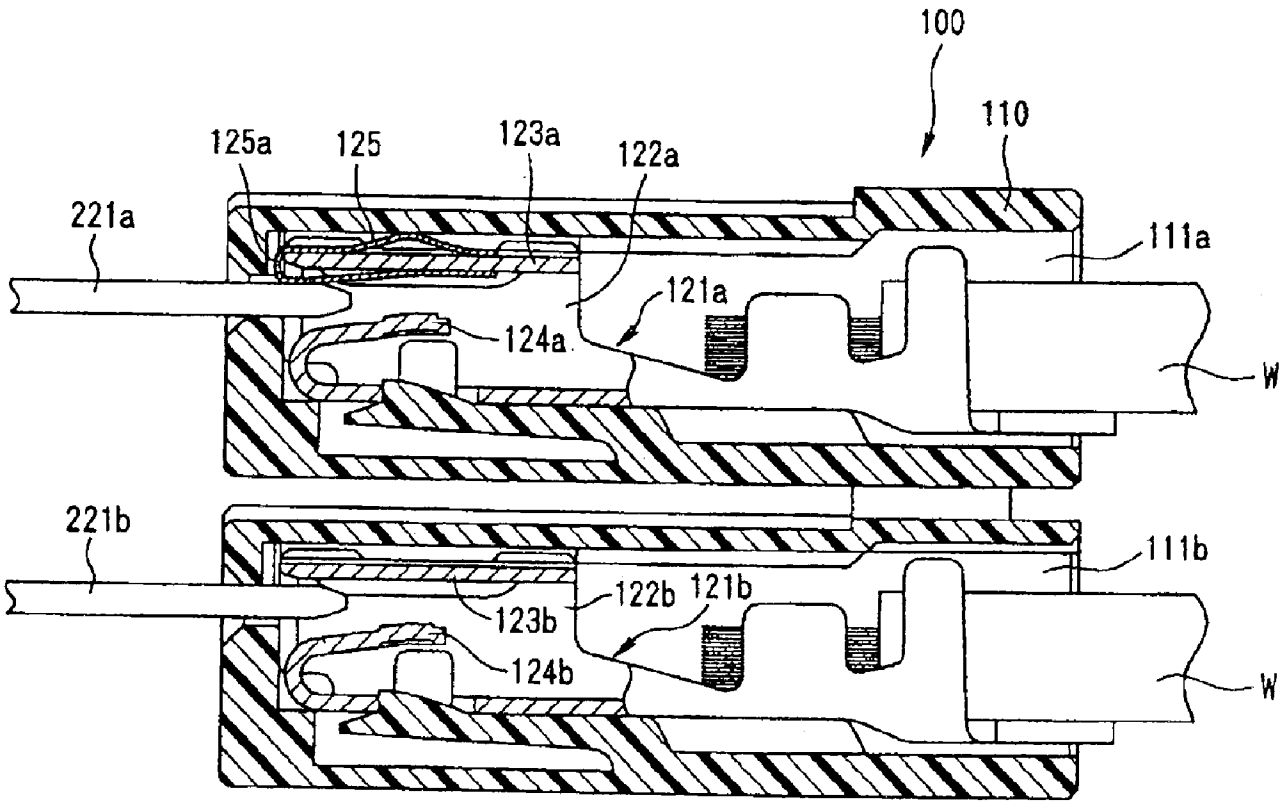
PRIOR ART FIG. 6
FIG. 6 is a sectional view of a prior art sequential connection-type connector.

Additional contact-receiving cavities 15 are formed each in front of the housing lance 16 of a respective one of the contact-accommodating cavities 11*a* and 11*b* and in communication with the respective one of the contact-accommodating cavity 11*a* and 11*b*. The additional contact-receiving cavities are narrower in width than the contact-accommodating cavities 11*a* and 11*b* (as shown in FIG. 3). The additional contact-receiving cavities 15 open in the front end of the housing 10. An escape recess $\mathbf{15}_1$ is formed above the front end of the upper additional contact receiving cavity 15 and allows the escape or movement of a contact arm 34 of the additional contact 30 (described below) when the contact arm 34 is displaced upward upon insertion of the post contact 42*a* into the contact-accommodating cavity 11*a*. Furthermore, an accommodating recess 14 extends downward from the upper opening 12 of the housing 10 and accommodates a narrow part $\mathbf{37}_1$ formed on the tip end of the contact arm 34 of the additional contact 30 when the contact arm 34 is displaced downward. The housing 10 is formed by molding an insulating synthetic resin.

Of the receptacle contacts 20*a* and 20*b*, the upper receptacle contact 20*a* constitutes a ground contact and the lower receptacle contact 20*b* constitutes a signal contact. The receptacle contacts 20*a* and 20*b* are formed by stamping and forming metal plates, and include electrical wire crimping parts 21 to which electrical wires (not shown) are crimped, and receptacle parts 22 that respectively accommodate the post contacts 42*a* and 42*b*. Elastic contact pieces 23 are arranged inside the receptacle parts 22 and elastically contact the post contacts 42*a* and 42*b* when the post contacts 42*a* and 42*b* are inserted into the openings defined by the receptacle contacts 20*a* and 20*b*.

During manufacture of the connector A, the receptacle contacts 20*a* and 20*b* are inserted (with the receptacle parts 22 being inserted first) into the respective one of the contact-accommodating cavities 11*a* and 11*b* from the rear end of the housing 10. When the receptacle contacts 20*a* and 20*b* are inserted into the contact-accommodating cavities 11*a* and 11*b*, the housing lances 16 are positioned to the rear of the receptacle parts 22, and prevent the receptacle contacts 20*a* and 20*b* from slipping out from the rear of the housing 10.

The additional contact 30 is inserted and arranged in the upper additional contact-receiving cavity 15 of the housing 10, i.e., in the space between the receptacle contact 20*a* inside the upper contact-accommodating cavity 11*a* and the inside wall of the housing 10. As shown in FIGS. 1 and 4(A)–5(B), the additional contact 30 has substantially an S-shape and includes a contact plate portion 31 which contacts the receptacle part 22 of the receptacle contact 20*a*, a bent portion 32 which extends from a rear end of the contact plate portion 31, an engaging portion 33 coupled to the contact plate portion via the bent portion 32, and a contact arm 34 which extends from the front end of the contact plate portion 31 and protrudes beyond the front end of the receptacle part 22 of the contact 20*a*. The contact arm 34 extends across the opening defined by the receptacle contact 20*a* for insertion of the post contact 42*a*, i.e., across the insertion path of the post contact 42*a* which is the path of the post contact 42*a* during insertion thereof into the contact-accommodating cavity 11*a*.

The additional contact 30 is formed by stamping and forming a metal plate containing, for example, stainless steel or other suitable materials. The engaging portion 33 of the additional contact 30 projects or bites into the inside (upper) wall of the housing 10 and the contact plate portion 31 contacts the receptacle part 22 of the receptacle contact 20*a* so that the additional contact 30 is clamped between the inside wall of the housing 10 and the receptacle contact 20*a*.

Since the additional contact 30 is inserted and arranged between the receptacle contact 20*a* inside the upper contact-accommodating cavity 11*a* and the inside wall of the housing 10, mounting of the additional contact 30 is easy even when relatively small receptacle contacts are present.

Also, since the additional contact 30 protrudes forward beyond the front end of the receptacle part 22 of the receptacle contact 20*a* and cuts across the insertion path of the post contact 42*a*, the post contact 42*a* is assured to contact the contact arm 34 upon its insertion into the contact-receiving cavity 11*a* so that a sequential connection can be reliably achieved.

In the non-limiting illustrated embodiment, by forming the additional contact 30 to have an S-shape, the size of the spring region can be increased so that the additional contact 30 does not have a tendency to undergo plastic deformation.

Since the additional contact 30 is clamped between the inside wall of the housing 10 and the receptacle contact 20*a* as a result of the engaging portion 33 projecting into the inside wall of the housing 10 and the contact plate portion 31 contacting the receptacle part 22 of the contact 20*a*, the elastic force of the bent portion 32 between the contact plate portion 31 and engaging portion 33 acts on the contact plate portion 31. In this manner, stable contact between the receptacle contact 20*a* and additional contact 30 can be ensured.

Referring now in particular to FIGS. 4(A)–4(C), the contact arm 34 also includes a spring plate portion 35 which extends from the front end of the contact plate portion 31 upward at an inclination toward the front and a contact portion 37 which extends from the front end of the spring plate portion 35 downward at an inclination toward the rear via a bent portion 36. The contact portion 37 cuts across the insertion path of the post contact 42*a* and is thus designed to contact the post contact 42*a* upon its insertion into the contact-accommodating cavity 11*a*.

A reduced-width portion $\mathbf{37}_1$ is formed on the tip end of the contact portion 37, and an inclined surface $\mathbf{37}_2$ is formed on the front surface of the reduced-width portion $\mathbf{37}_1$. The inclined surface $\mathbf{37}_2$ serves to alleviate the load on the side of the additional contact 30 when the mating connector B is mated at an inclination so that the post contact 42*a* contacts the reduced-width portion $\mathbf{37}_1$. The tip end surface $\mathbf{37}_3$ of the reduced-width portion $\mathbf{37}_1$ has a semi-circular shape in order to ensure smooth sliding with the post contact 42*a*. The front corner edges of the contact portion 37 and reduced-width portion $\mathbf{37}_1$ have a rounded shape. As a result of the front corner edges of the contact portion 37 and reduced-width portion $\mathbf{37}_1$ having a rounded shape, damage to the post contact 42*a* in the case of inclined mating of the mating connector B can be avoided, and smooth contact with the post contact 42*a* can be ensured.

Figure 2:
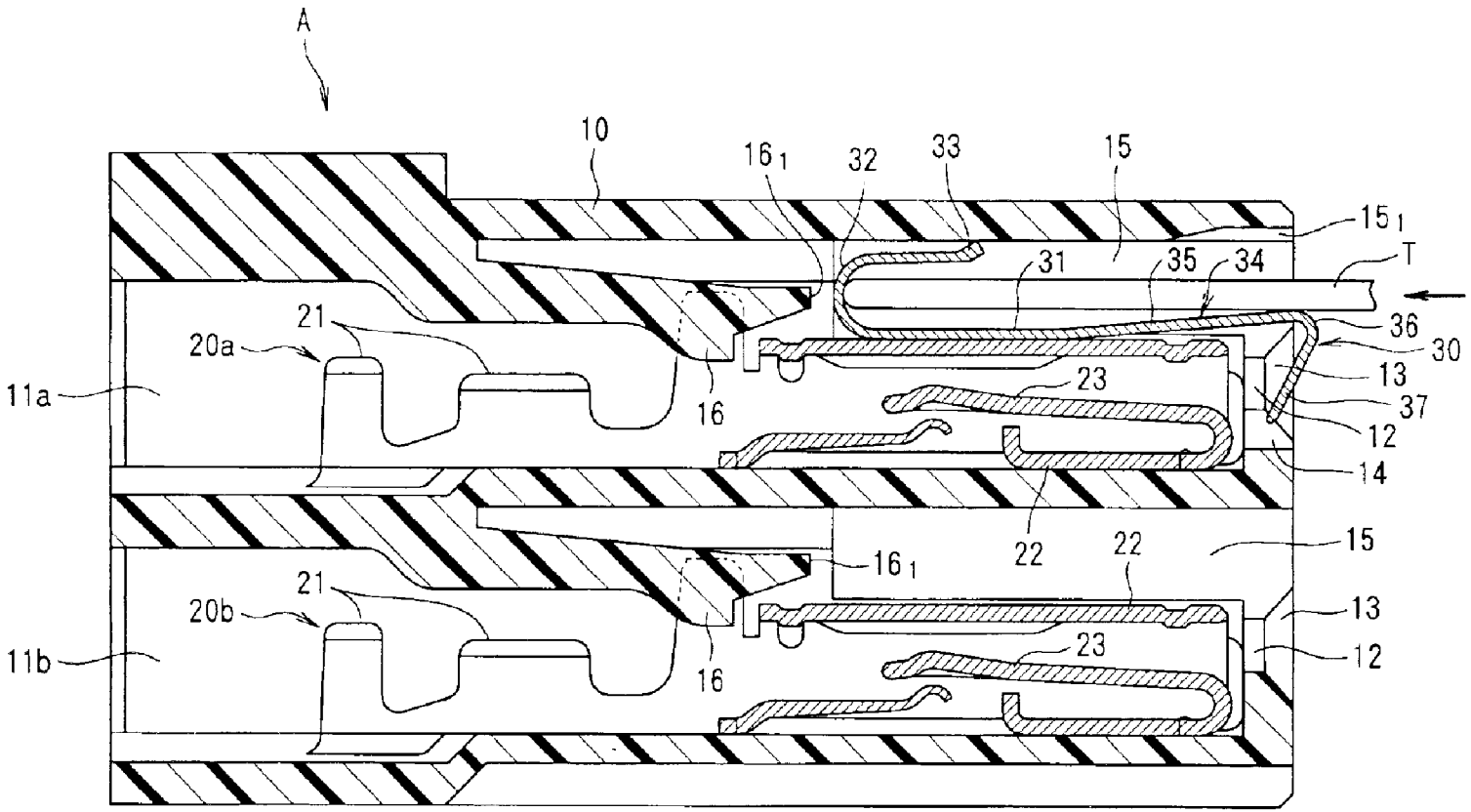
FIG. 2 is a sectional view which illustrates a method by which the additional contact is inserted and arranged inside the additional contact-receiving cavity.

As shown in FIG. 2, the additional contact 30 is inserted into the upper additional contact-receiving cavity 15 from the front side of the housing 10 by pushing the inside of the bent portion 32 with a tool T. In this case, the additional contact 30 is inserted into the additional contact-receiving cavity 15 in the same direction as the direction of insertion of the post contacts 42*a* and 42*b*. Insertion of the additional contact 30 is limited as a result of the outside of the bent portion 32 of the additional contact 30 abutting against the tip end of the housing lance 16. Thus, accurate positioning of the additional contact 30 in the direction of insertion can be accomplished.

As a result of the bent portion 32 of the additional contact 30 abutting against the tip end of the housing lance 16, engagement of the receptacle contact 20*a* by the housing lance 16 can be reinforced. When the additional contact 30 is inserted into the additional contact-receiving cavity 15 by pushing the inside of the bent portion 32 with the tool T, the tool T contacts the upper surface of the bent portion 36 of the contact arm 34 as shown in FIG. 2, and the spring plate portion 35 is displaced downward, so that the reduced-width portion $\mathbf{37}_1$ moves downward. In this case, the reduced-width portion $\mathbf{37}_1$ is accommodated inside the accommodating recess 14 that extends downward from the upper opening 12 of the housing 10. Accordingly, insertion of the additional contact 30 into the additional contact-receiving cavity 15 can easily be accomplished.

Expanded-width portions 38 are formed on the side portions of the additional contact 30 in the vicinity of the engaging part 33 (see FIGS. 4(A) and 4(C)). Expanded-width portions 39 are also formed on the side portions of the spring plate portion 35. Expanded-width portions 38 and 39 regulate the movement of the additional contact 30 in a direction perpendicular to the direction of insertion, i.e., a lateral direction of the additional contact 30, by contacting the inside walls of the additional contact-receiving cavity 15. When the expanded-width portions 38 and 39 of the additional contact 30 contact the inside walls of the additional contact-receiving cavity 15 during and/or after the insertion and arrangement of the additional contact 30 in the additional contact-receiving cavity 15, the movement of the additional contact 30 in the direction perpendicular to the direction of insertion is regulated. As a result, the deviation of the additional contact 30 in the direction perpendicular to the direction of insertion can be minimized.

The outside corner portions of the expanded-width portions 39 formed on the side portions of the spring plate portion 35 have a rounded shape. As a result, it is possible to minimize the effect of the contact of the expanded-width portions 39 on the inside walls of the additional contact-receiving cavity 15 when the spring plate portion 35 is displaced.

Referring back to FIG. 1, when the mating connector B is mated and connected in a state in which the additional contact 30 is inserted and arranged inside the upper additional contact-receiving cavity 15, the tip end of the upper post contact 42*a* that constitutes a ground contact first contacts the outside surface of the contact portion 37 of the additional contact 30. As a result, the upper post contact 42*a* that constitutes a ground contact and the upper receptacle contact 20*a* that constitutes a ground contact are first electrically connected. Then, as the insertion of the post contact 42*a* progresses, the post contact 42*a* slides along the outside surface of the contact portion 37 and tip end surface $\mathbf{37}_3$ of the reduced-width portion $\mathbf{37}_1$, causing the contact arm 34 to be displaced upward about a pivot point situated in the vicinity of the rear end portion of the spring plate portion 35. When the contact arm 34 is displaced upward, the bent portion 36 of the contact arm 34 is positioned inside the escape recess $\mathbf{15}_1$ formed in the additional contact receiving cavity 15 so that contact between the contact arm 34 and housing 10 is avoided. When the insertion of the post contact 42*a* progresses further, the post contact 42*a* is received inside the receptacle part 22 of the upper receptacle contact 20*a* so that the post contact 42*a* contacts the elastic contact piece 23. At the same time, the lower post contact 42*b* which constitutes a signal contact is received inside the receptacle part 22 of the lower receptacle contact 20*b* which constitutes a signal contact so that the post contact 42*b* contacts the elastic contact piece 23. As a result, the lower post contact 42*b* that constitutes a signal contact and the lower receptacle contact 20*b* that constitutes a signal contact are electrically connected.

Thus, in the present invention, as a result of the insertion and presence of the additional contact 30 inside the upper additional contact-receiving cavity 15, the upper post contact 42*a* that constitutes a ground contact and the upper receptacle contact 20*a* that constitutes a ground contact are first electrically connected and only thereafter, the lower post contact 42*b* that constitutes a signal contact and the lower receptacle contact 20*b* that constitutes a signal contact are electrically connected. Accordingly, a sequential connection is achieved.

One embodiment of the present invention is described above. However, the present invention is not limited to this embodiment and various alterations are possible.

For example, the receptacle contacts 20*a* and 20*b* are not required to be arranged in two tiers or rows one above the other and the contacts could also be arranged in a single tier, or in three or more tiers one above another.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. A sequential connection-type connector comprising:

an insulative housing having contact-accommodating cavities and at least one inside wall;

receptacle contacts arranged in said contact-accommodating cavities and each defining an opening receivable of a mating male contact; and an additional contact arranged between one of said receptacle contacts and said inside wall of said housing, said additional contact including a contact plate portion in contact with said receptacle contact, an engaging portion protruding into said inside wall, a bent portion extending from a rear end of said contact plate portion and interposed between said contact plate portion and said engaging portion, and a contact arm extending from a front end of said contact plate portion and protruding in front of a front end of said receptacle contact, said contact arm extending across said opening in said receptacle contact;

whereby with said contact plate portion being in contact with said receptacle contact and said engaging portion protruding into said inside wall, said additional contact is clamped between said inside wall and said receptacle contact.

2. The sequential connection type connector according to claim 1, wherein said additional contact has a substantially S-shape.

3. The sequential connection type connector according to claim 1, wherein said housing further includes a housing lance, said bent portion of said additional contact abutting against said housing lance to thereby position said additional contact in said housing.

4. The sequential connection type connector according to claim 3, wherein said housing lance has a forward tip end, said bent portion of said additional contact abutting against said tip end of said housing lance.

5. The sequential connection type connector according to claim 1, wherein said additional contact further comprises at least one expanded-width portion arranged to regulate movement of said additional contact in a lateral direction.

6. The sequential connection type connector according to claim 1, wherein said additional contact further comprises a first expanded-width portion interposed between said bent portion and said engaging portion for regulating movement of said additional contact in a lateral direction.

7. The sequential connection type connector according to claim 6, wherein said contact arm comprises a second expanded-width portion for regulating movement of said additional contact in a lateral direction.

8. The sequential connection type connector according to claim 1, wherein said contact arm comprises an expanded-width portion for regulating movement of said additional contact in a lateral direction.

9. The sequential connection type connector according to claim 1, wherein said housing further includes an additional contact-receiving cavity in which said additional contact is arranged, said additional contact-receiving cavity having a narrower width than a width of said contact-accommodating cavity in which said receptacle contact in contact with said additional contact is arranged.

10. The sequential connection type connector according to claim 9, wherein said housing further includes an escape recess formed above said additional contact-receiving cavity to receive said contact arm upon movement of said contact arm caused by insertion of the male mating contact into said opening defined by said receptacle contact.

11. The sequential connection type connector according to claim 1, wherein said housing further includes an accommodating recess arranged in front of said receptacle contact in contact with said additional contact and to receive a tip end of said contact arm of said additional contact.

12. The sequential connection type connector according to claim 1, wherein said contact arm includes a spring plate portion inclined away from said receptacle contact in contact with said additional contact and extending from the front end of said contact plate portion.

13. The sequential connection type connector according to claim 12, wherein said contact arm further includes a bent portion arranged at a front end of said spring plate portion and a contact portion connected to said bent portion and extending downward at an angle toward a rear of said housing, said contact portion extending across said opening in said receptacle contact.

14. The sequential connection type connector according to claim 13, wherein said contact arm further includes a reduced-width portion formed at an end of said contact portion.

15. An additional contact for a sequential connection-type connector including an insulating housing having contact-accommodating cavities and at least one inside wall, and receptacle contacts arranged in the contact-accommodating cavities and each defining an opening receivable of a mating male contact, the additional contact comprising:

a contact plate portion adapted to contact one of the receptacle contacts, an engaging portion adapted to protrude into the inside wall of the housing, a bent portion extending from a rear end of said contact plate portion and interposed between said contact plate portion and said engaging portion, a contact arm extending from a front end of said contact plate portion, said contact arm being adapted to protrude in front of a front end of the receptacle contact and extend across the opening in the receptacle contact, said contact arm includes a spring plate portion inclined away from said receptacle contact in contact with said additional contact and extending from the front end of said contact plate portion, a bent portion arranged at a front end of said spring plate portion and a contact portion connected to said bent portion and extending downward at an angle toward a rear of said housing, said contact portion extending across said opening in said receptacle contact.

16. The additional contact according to claim 15, wherein said contact arm further includes a reduced-width portion formed at an end of said contact portion.

17. The additional contact according to claim 15, wherein said additional contact further comprises at least one expanded-width portion arranged to regulate movement of said additional contact in a lateral direction.

18. The additional contact according to claim 15, wherein said additional contact has a substantially S-shape.

* * * * *